United States Patent [19]

Jones

[11] 4,128,273

[45] Dec. 5, 1978

[54] ROCKABLE AGAINST-THE-WALL TYPE RECLINING CHAIR

[76] Inventor: W. Dale Jones, 7020 Aztec Dr. NE., Albuquerque, N. Mex. 87110

[21] Appl. No.: 840,668

[22] Filed: Oct. 11, 1977

Related U.S. Application Data

[63] Continuation-in-part of Ser. No. 720,244, Sep. 13, 1976, Pat. No. 4,057,289.

[51] Int. Cl.[2] ..... A47C 1/02

[52] U.S. Cl. ..... 297/327; 297/84; 297/259; 297/265; 297/270; 297/318; 297/344; 297/DIG. 7

[58] Field of Search ..... 297/259, 261, 264–266, 297/270, 271, 272, 310, 311, 327, 329, 344, DIG. 7, 84, 318

[56] References Cited

U.S. PATENT DOCUMENTS

| | | | |
|---|---|---|---|
| 144,603 | 11/1873 | Enger | 297/329 |
| 465,719 | 12/1891 | Mitchell | 297/266 X |
| 665,005 | 1/1901 | Harmon | 297/261 |
| 2,270,172 | 1/1942 | Ruegger | 297/329 |
| 2,940,509 | 6/1960 | Fletcher | 297/329 X |
| 3,295,885 | 1/1967 | Barrsdale | 297/271 X |
| 3,669,490 | 6/1972 | Bertelot | 297/272 |
| 3,730,585 | 1/1973 | Rogers et al. | 297/DIG. 7 |
| 3,758,151 | 9/1973 | Re | 297/259 X |
| 4,072,342 | 2/1978 | Johnson et al. | 297/84 |

*Primary Examiner*—James C. Mitchell
*Attorney, Agent, or Firm*—Learman & McCulloch

[57] ABSTRACT

A rockable against-the-wall type reclining chair in which the rocking and reclining elements of the chair are mounted upon a carriage gravitationally maintained at either of a forward or rearward end limit of movement upon a carriage supporting track assembly pivotally mounted upon a stationary base. Rocking or reclining of the chair elements may take place at the option of an occupant of the chair when the carriage is at its forward end limit of movement, at which time rocking or reclining movement of the chair back will clear any wall surface which may be located closely adjacent the rear of the base. The carriage is automatically returned to its rearward limit when the occupant arises from the chair, and upon return of the carriage to its rearward limit, the chair elements are automatically latched against reclining or rearward rocking movement.

9 Claims, 4 Drawing Figures

ROCKABLE AGAINST-THE-WALL TYPE RECLINING CHAIR

REFERENCE TO RELATED APPLICATIONS

This application discloses certain improvements to subject matter disclosed in my co-pending application Ser. No. 880,667, filed concurrently herewith, and is also a continuation-in-part of my application Ser. No. 720,244, filed Sept. 3, 1976 now U.S. Pat. No. 4,057,289.

BACKGROUND OF THE INVENTION

In my earlier filed application referred to above, there is disclosed my first version of an against-the-wall type reclining chair which also possessed the capability of being rocked. In that particular form of against-the-wall rockable reclining chair, the chair frame, upon which the reclining elements of the chair were mounted by the reclining linkage, was movable upon the chair base between rearward and forward end limits of movement. In common with previously known against-the-wall type reclining chairs, the chair frame was coupled to the base by means of a translation linkage actuated by the reclining linkage in a manner such that when the chair was shifted into a reclined position, the translation linkage drove the chair frame forwardly upon the base so that the reclining chair back would not strike a wall or other surface located closely adjacent the rear of the chair.

The chair disclosed in my U.S. Pat. No. 4,057,289 because of the coupling between the reclining linkage and the translation linkage, is automatically driven away from the wall by the initiation of a reclining movement and is provided with a stop arrangement which prevents rearward rocking movement of the chair when in its normal upright position against the wall.

In my co-pending application Ser. No. 880,667 there is disclosed several forms of against-the-wall type rockable reclining chairs which dispense with the translation linkage employed in my earlier filed application. Generally speaking, the the chairs disclosed in my co-pending application Ser. No. 880,667 are shifted to a forward end limit of movement relative to their base gravitationally in a movement initiated by a forward rocking or forward impetus applied to the chair by the occupant. While rearward rocking movement of the chair when in its against-the-wall position is prevented by a suitable stop arrangement, it is possible for the occupant to attempt to recline the chair when in the against-the-wall position with the result that under certain conditions such a reclining movement could find the reclining chair back striking a closely adjacent wall surface.

It is therefore an object of the present invention to provide a rockable reclining chair capable of being located closely adjacent a wall or other surface in which rearward rocking or reclining of the chair can occur only when the chair elements have sufficient clearance from the wall or other surface.

SUMMARY OF THE INVENTION

In a chair embodying the present invention, the chair seat and back, and in the usual case a foot rest, are supported upon a chair frame by a suitable reclining chair linkage which can take the form of any of several commercially available linkages. The chair frame in turn is supported by a rocker spring unit upon a carriage having opposed pairs of rollers received in opposed roller tracks which constitute opposite sides of a rigid track assembly. The longitudinal extent of the track members is such as to enable the carriage to roll along the tracks between spaced forward and rearward end limits of movement.

The track assembly is mounted upon a stationary base for pivotal movement about a horizontal axis normal to the longitudinal extent of the tracks between a normally maintained rest position in which the tracks are inclined downwardly toward the rear of the chair and what may be termed an actuated position in which the tracks are inclined downwardly toward the front of the chair. The inclination of the tracks thus gravitationally biases the carriage toward one or the other of its forward or rearward end limits of movement. A tension spring is coupled between the track assembly and the stationary base to normally bias the track assembly to its normal or rearwardly and downwardly inclined position, and thus the carriage and the remaining elements of the chair supported upon the carriage are normally biased gravitationally to their rearward end limit of movement relative to the base. In this position, the chair back may be located closely adjacent to a wall.

When an occupant of the chair wishes to recline or to rock the chair, the occupant initiates a forward rocking movement which tilts the track assembly from its normally maintained rearward inclination into a forward inclination, thus permitting the carriage to roll gravitationally forwardly along the track assembly to its forward end limit of movement. When the carriage is at its forward end limit of movement, reclining or rocking of the chair can occur without any possibility of the chair back colliding with the adjacent wall surface. When the occupant arises from the chair, the chair seat and back are restored to their normal upright position and a return spring is operable, when the weight of the occupant is removed from the chair, to return the carriage to its rearward end limit of movement, at which the tension spring referred to above resiliently restores the track assembly to its rearwardly inclined position, thus gravitationally biasing the carriage to its rearward end limit of movement.

To prevent rearward rocking or reclining of the chair when the carriage is at its rearward end limit of movement, a latch striker member is rigidly fixed to and projects downwardly from the chair back. A latch member is pivotally mounted upon the chair frame, and a cam mounted on the chair base maintains the latch member in a latching position engaged with the striker to lock the chair back against reclining movement. The engagement between the cam and the latch also acts as a stop preventing rearward rocking movement of the chair when the latch is engaged. The cam is so arranged that the latch is swung, by engagement with the cam, into its latching position as the chair approaches its rearward end limit of movement relative to the base.

Other objects and features of the invention will become apparent by reference to the following specification and to the drawings.

IN THE DRAWINGS

Figure 2:
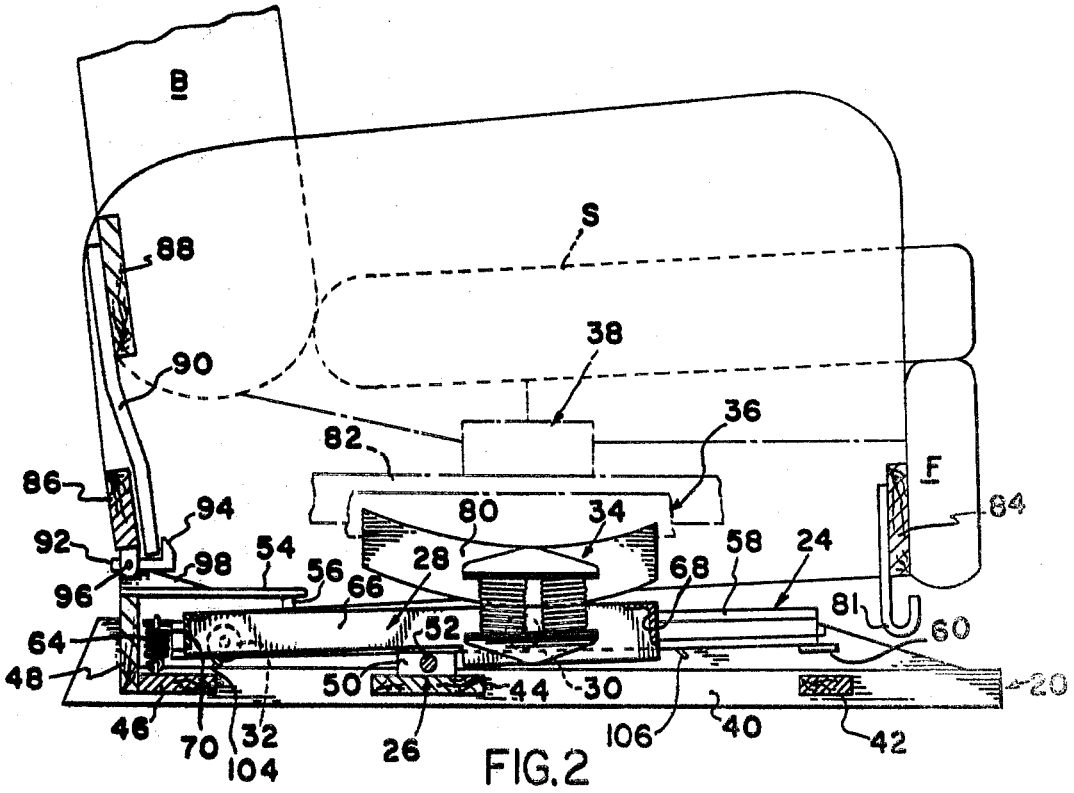
FIG. 2 is a cross sectional view taken approximately on the line 2—2 of FIG. 1.

A rockable reclining chair embodying the present invention is constructed from several basic sub-assemblies which include:

a base designated generally 20, a track assembly designated generally 24 which is mounted for pivotal movement upon the base 20 as at 26, a carriage designated generally 28 which is supported for forward and rearward movements upon track assembly 24 as by front and rear rollers 30 and 32, rocker spring assemblies designated generally 34, a chair frame designated generally 36 supported by rocker spring assemblies 34 for rocking movement upon carriage 28, reclining chair linkage schematically indicated generally at 38, a chair seat S, chair back B, and in the usual case a chair foot rest F mounted by linkage 38 upon chair frame 36 for coordinated movement between a normal upright position shown in full line in FIG. 2 and a reclined position.

Linkage 38 may take the form of any of several well known and commercially available reclining chair linkages, as, for example, that described in U.S. Pat. No. 3,730,585 and is thus shown only schematically.

Base 20 includes a pair of spaced parallel side frame members 40 which are rigidly interconnected to each other by transversely extending cross frame members 42, 44, and 46 and a generally vertically extending rear cross frame member 48. A pair of bearing blocks 50 fixedly mounted on the middle cross frame member 44 pivotally receive an elongate pivot shaft 52 which is fixedly secured at its opposite ends to track assembly 24 to define the pivotal support 26 for track assembly 24 upon base 20. The limits of pivotal movement of track assembly 24 upon base 20 are determined by the engagement with the forward end of the track assembly 24 with the top of front cross frame member 42 to define the maximum forward inclination of track assembly 24 or by the engagement with the rearward end of the track assembly 24 with the horizontal rearwardmost cross frame member 46 which defines the limit of rearward inclination of the track assembly relative to the base 20.

Base 20 further includes, at its rearward end, a horizontally extending guard plate 54 which extends forwardly from the upper side of vertical cross frame member 48 and has its forward end supported, as by posts 56 on side frame members 40 a sufficient distance above track assembly 24 to accommodate the pivotal movement of track assembly 24 described above.

Figure 3:
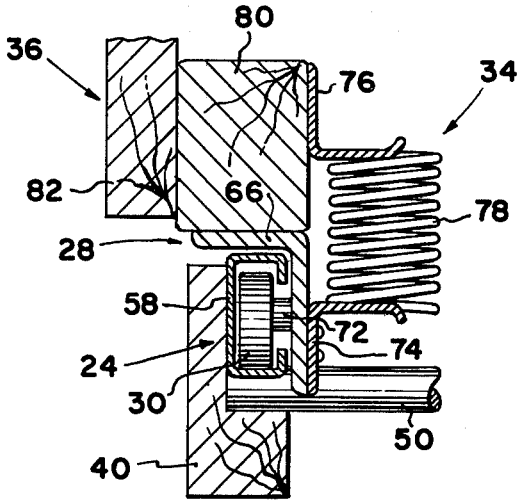
FIG. 3 is a detailed cross sectional view taken on the line 3—3 of FIG. 1.

Track assembly 24 includes a pair of opposed parallel track members 58 of generally C-shaped transverse cross section, see particularly FIG. 3. The opposed track frame members 58 are rigidly interconnected to each other as by front and rear cross frame members 60, 62, as well as by pivot shaft 52, members 60, 62 and shaft 52 being welded to the respective track members 58 to constitute the track assembly 24 as a rigid, generally rectangular assembly. A pair of tension springs 64 are connected between the rearward ends of the respective track members 58 and the horizontal rear cross frame member 46 of base 20 to resiliently bias the rearward end of track assembly 24 downwardly about the pivotal axis established by shaft 52 so that springs 64 normally bias the track assembly to the rearwardly inclined position shown in FIG. 2.

Carriage 28 includes a pair of spaced parallel side frame members 66 which are rigidly interconnected to each other by front and rear cross frame members 68 and 70. As best seen in the cross sectional view of FIG. 3, carriage side frame members 66 are of an inverted L-shaped transverse cross section, with rollers 30 and 32 being rotatably supported from the vertical web of member 66 as by axles 72.

As best seen in FIG. 3, the lower mounting bracket 74 of rocker spring unit 34 is fixedly secured, as by riveting, to the inner side of the vertical web of carriage frame member 66. The upper bracket 76 of rocker spring unit 34 which is interconnected to lower bracket 74 by springs 78, is fixedly secured to the inner side of a rocker element 80 which rests upon the horizontal upper web of frame member 66 for rocking movement resiliently resisted by the twin springs 78 of unit 34. Rocker member 80 is in turn fixedly connected to chair frame 36.

The rocker spring units 34 are so mounted that the normal position of the occupied chair is a slightly rearwardly tilted position. This normally locates the center of gravity of the chair, during normal rocking and reclining a sufficient distance rearwardly relative to the base side frame members 40 so that normal rocking movement will not lift the rear ends of members 40 from the floor. To ensure that extreme forward rocking movement will not tilt the rear of the base clear of the floor, forward rocking stops 81 are mounted on the front cross frame member 84 of chair frame 36 to limit forward rocking movement of the frame.

Chair frame 36 includes a pair of side frame members 82 rigidly interconnected by front and rear cross frame members 84, 86. Rocker elements 80 are rigidly connected to side frame members 82 of the chair frame, and normally certain elements of reclining linkage 38 will also be mounted upon the chair side frame members 82. The seat S, back B and foot rest F elements of the chair also include their own individual frame members (not shown) appropriately connected to linkage 38, however, of these latter frame members only a lower cross frame member 88 of the chair back B is of concern in the present disclosure.

Figure 4:
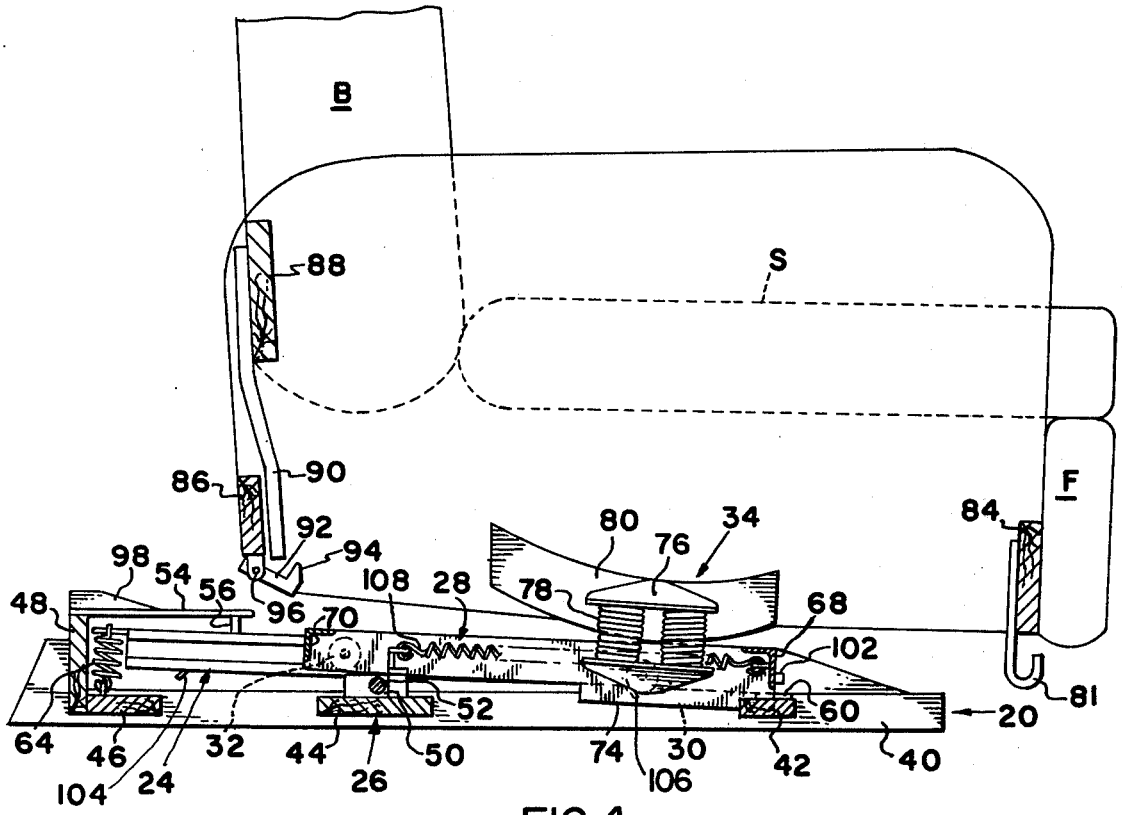
FIG. 4 is a cross sectional view similar to FIG. 2, but showing the chair with the carriage at its forward end limit of movement.

As best seen in FIGS. 2 and 4, a downwardly projecting latch striker member 90 is fixedly mounted upon the chair back frame member 88 and projects downwardly from member 88 to lie adjacent the forward side of rear cross frame member 86 of chair frame 36 when the chair back is supported by linkage 38 in its upright position relative to chair frame 36. A latch member 92 having an upwardly projecting latch tooth 94 is mounted as at 96 for free pivotal movement upon and underneath the lower edge of rear chair frame cross member 86. As best seen in FIG. 2, when carriage 28 is at its rearward end limit of movement upon track assembly 24, the pivoted latch member 92 is supported in a generally horizontal position by a cam 98 which is fixedly mounted upon the top of guide plate 54. When latch member 92 is so supported by cam 98, the upwardly projecting latch tooth 94 on the latch member projects upwardly in front of striker member 90 on the chair back B, to latch the chair back against reclining movement from its upright position shown in FIG. 2. Because the chair back B is coupled to the seat S and foot rest F by linkage 38, this latching action is transmitted via reclining linkage 38 to the chair seat S and to the foot rest F, thus also latching these elements in the normal upright condition shown in FIG. 2. It should further be noted that the engagement between latch member 92 and cam 98 prevents downward movement of the rearward end of chair frame 36, thus also preventing rearward rocking movement of the chair frame upon rocker member 80.

Referring now to FIG. 4, it is seen that when carriage 28 is moved forwardly away from its rearward end limit of movement to a point where latch member 92 is no longer engaged by cam 98, latch member 92 is free to swing downwardly, under the influence of gravity, about its pivotal mounting 96 to a location where latch tooth 94 is clear of the arcuate path of movement of striker member 90 occasioned by reclining movement of the chair back.

OPERATION

In FIG. 2, the chair back B, seat S and foot rest F are shown in their normal upright positions, with latch tooth 94 in latching relationship to striker member 90 to latch the back, seat and foot rest in the upright position, as described above. In FIG. 2, the chair carriage 28 is at its rearward end limit of movement upon track assembly 24 with track assembly 24 inclined downwardly toward the rear of the chair. Tension springs 64 resiliently maintain the track assembly 24 in this downwardly and rearwardly inclined position, the weight of the chair frame, linkage, seat, back and foot rest being applied to the carriage via rocker element 80 at a point forwardly of the track pivot axis (pivot shaft 26).

The force applied by the springs 64 tending to maintain the track assembly in its illustrated downwardly and rearwardly inclined position is applied over a much greater lever arm (from pivot shaft 52) than is the gravitational force of the chair elements applied in opposition to the force of springs 64 at the point of contact between rocker elements 80 and the carriage, hence a relatively small spring force is operable to maintain the chair in the position shown in FIG. 2.

When an occupant is seated in the chair with the chair in the FIG. 2 configuration, the weight of the occupant is added to the weight of those chair elements supported upon rocker element 80, thus increasing the force tending to pivot track assembly 24 forwardly and downwardly above pivot shaft 26. The characteristic of spring 64 is selected to be such that the gravitational forces of the occupied chair acting downwardly through rocker elements 80, for an occupant of average weight, is approximately counter-balanced by the spring tension exerted by springs 64 so that track assembly 24 does not pivot from the position shown in FIG. 2 beyond a horizontal position when the chair is occupied. Thus, when the chair in the position shown in FIG. 2 is occupied, track assembly 24 may pivot very slightly from the FIG. 2 position, but will not, as long as the occupant assumes a normal position in the chair, pivot beyond the horizontal position. Rear rollers 32 are at this time seated in downstruck detent like depressions 104 in tracks 58 to releasably retain the carriage at its rearward end limit of movement relative to track assembly 24.

If the chair occupant desires to recline or to rock the chair, the occupant will shift his weight to rock the chair slightly forwardly upon rocker elements 80. This action shifts the point at which rocker elements 80 engage carriage 28 somewhat forwardly from the position shown in FIG. 2, thus increasing the effective lever arm of the point of application of the weight of the occupied chair forwardly from pivot shaft 26. At the same time, rear rollers 32 are urged out of detents 104 to free carriage 28 for forward movement. This increased leverage overcomes the restraining force exerted by springs 64, thus permitting track assembly 24 to pivot about shaft 26 into a downwardly and forwardly inclined position. Carriage 28 is thus free to roll, under the influence of gravity, forwardly along the downwardly inclined tracks, thus further increasing the force gravitationally biasing track assembly 24 into its forward and downwardly inclined position. Carriage 28 will thus roll forwardly along tracks 24 freely until cross frame member 68 engages carriage stops 102 at the forward end of track assembly 24, as shown in FIG. 4. When front cross frame members of carriage 28 engages carriage stops 102, front rollers 30 of the carriage drop into struckdown depressions 106 in the lower surface of tracks 58, the depressions 106 functioning as a detent tending to releasably retain carriage 28 at its forward end limit of movement shown in FIG. 4.

From FIG. 4 it will be noted that when carriage 28 is at its forward end limit of movement, latch member 92 pivots downwardly clear of latch striker 90 so that the chair can be reclined, if desired. The chair is also free to be rocked upon rocker members 80. A rocking stop 81 fixedly mounted on the front chair frame cross member 84 projects downwardly to limit forward rocking movement of the chair, in order to prevent lifting of the rearward end of base 20 from the floor by an excessive forward rocking movement.

When the occupant arises from the chair, the chair will automatically be restored to the FIG. 2 position. To arise from the chair, the occupant normally must first return the chair seat, back and foot rest to the normal upright position, the arrangement of most chairs being such that it is difficult, if not impossible, to arise from the chair without restoring the seat and foot rest, and hence the back, to the normal upright position. With the weight of the occupant released from the chair, the reduced gravitational force holding the front carriage rollers 30 in the detent like depressions 106 is overcome by the force of a tensioned return spring 108 coupled between the central base cross frame member 44 and front cross frame member 68 of carriage 28. Further, the removal of the weight of the occupant from a chair greatly reduces the gravitational force opposing the action of track biasing spring 64. Thus, return spring 108 shifts the chair to the left from the position shown in FIG. 4, while at the same time springs 64 urge track assembly 24 in counterclockwise pivotal movement about shaft 52. The farther the carriage 28 and the supporting chair elements move to the left from the FIG. 4 position, the more the force acting in opposition to springs 64 is reduced since the leftward movement of carriage 28 constantly reduces the lever arm of the gravitational forces applied to the carriage by rocker elements 80. Thus, the carriage returns to the FIG. 2 position, with latch member 92 riding up the inclined surface of cam 98 as the assembly approaches the FIG. 2 position to swing latch member 92 upwardly into the latched position shown in FIG. 2 as the chair arrives at its rearward end limit of movement.

Alternatively, the chair can be restored from the FIG. 4 position to the FIG. 2 position by the occupant by first moving the chair seat, back and foot rest to the normal upright position and then exerting a rearward push on the chair to drive front rollers 32 of the carriage out of detent like depressions 106.

Figure 1:
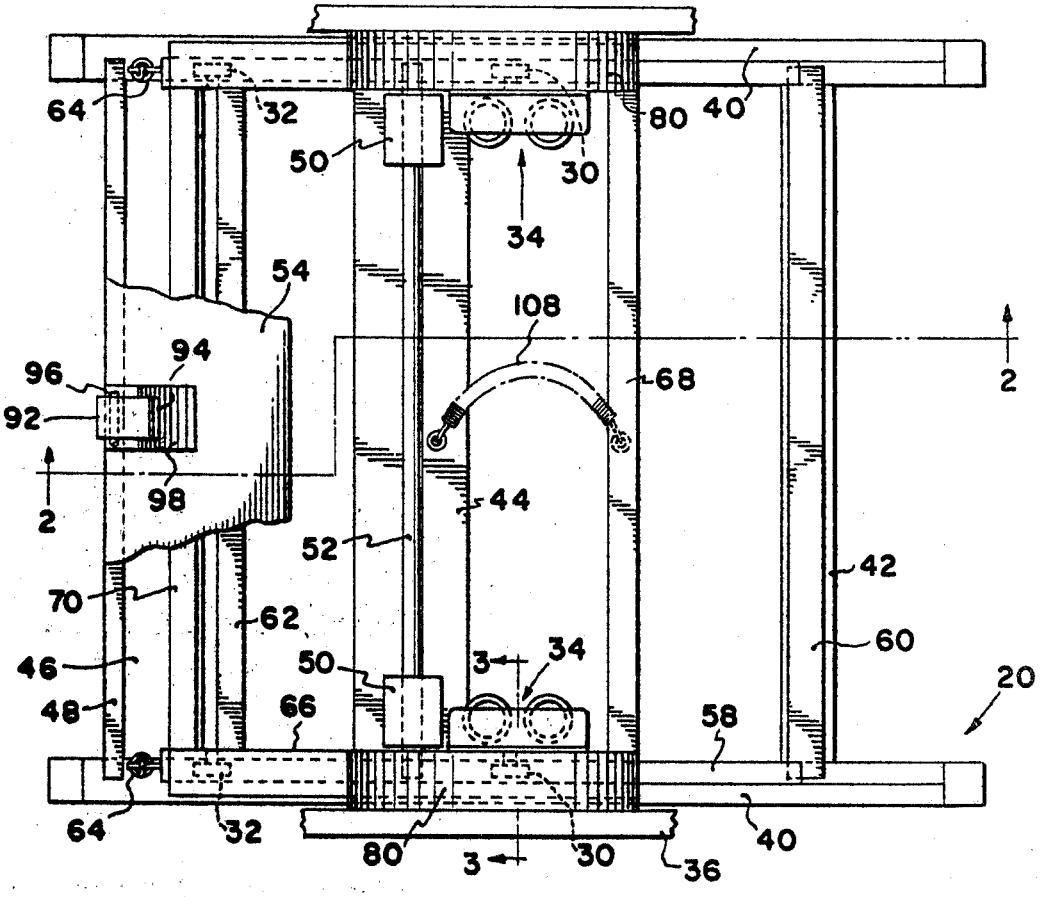
FIG. 1 is a top plan view of a chair embodying the present invention with certain parts broken away.

It will be noted from FIG. 1 that when the carriage is at its rearward end limit of movement, return spring 108 is slack so that this spring exerts no force tending to restrain the carriage at its rearward end limit of movement and does not begin to exert any biasing action until the chair has moved away from its rearward end limit of movement.

As explained above, when the chair is in the FIG. 2 position, latch member 92 holds striker member 90 of the chair back against forward movement to thus latch the chair elements in their normal upright position. Because chair back B, chair seat S, and foot rest F are all interconnected to each other for coordinated movement relative to chair frame 36 by linkage 38, the mounting of striker 90 upon the chair back is but one of several ways in which latching of the chair in its normal upright position could be performed in that the locking of one of the back, seat, foot rest or linkage in the normal upright position automatically locks all of these elements. The latch 92 not only prevents reclining movement of the chair when the carriage is at its rearward end limit of movement, but also prevents rearward rocking movement of the chair, thereby enabling the chair base to be located in close proximity to a wall without having the chair back contact the wall during reclining or rocking movement.

Forward rocking of the chair can take place when the carriage is at its rearward end limit of movement, however, if this forward rocking movement is large enough to elevate rear chair frame member 86 to a point where latch 92 releases striker member 90, the movement is also large enough to tilt tracks 24 into their forwardly inclined position to gravitationally convey the carriage to its forward end limit. Thus, reclining and rocking movement of the chair of the present invention can take place only when the chair back is shifted forwardly away from the wall so that sufficient clearance for rocking and reclining action is provided.

While one embodiment of the invention has been described in detail, it will be apparent to those skilled in the art that the embodiment described may be modified. Therefore, the foregoing description is to be considered as exemplary rather than limiting, and the true scope of the invention is that defined in the following claims.

What is claimed is:

1. In an against-the-wall type reclining chair having a base, a chair frame, a chair seat and a chair back, and reclining linkage means mounting at least one of said seat and said back upon said frame for movement relative to said frame between an upright position and a reclined position; the improvement comprising a pair of elongate spaced opposed parallel track members rigidly interconnected to each other and extending in a front to rear direction adjacent each side of said base, pivot means mounting said track members for pivotal movement relative to said base about a horizontal axis normal to the longitudinal extent of said track members, stop means engageable between said track members and said base establishing end limits of pivotal movement of said track members about said axis at a first limit wherein said track members are inclined downwardly and rearwardly relative to said base and a second limit wherein said track members are inclined downwardly and forwardly relative to said base, a chair frame supporting carriage mounted upon said track means for gravitationally induced movement longitudinally of said track means between a forward and a rearward end limit of movement in accordance with the direction in which said track members are inclined; the weight of an occupant of said chair normally maintaining said carriage at either end limit at which it may be located and said carriage being movable to the opposite end limit in a movement induced by a shifting of the weight of the occupant, and restraining means for preventing reclining movement of said back from said upright position when said carriage is at said rearward end limit of movement while accommodating reclining movement of said back when said carriage is at said forward end limit of movement.

2. The invention defined in claim 1 further comprising rocker spring means including a rocker element fixedly secured to said chair frame and having a convexly curved lower rocking surface resting on said carriage, said rocking surface normally engaging said carriage at a location forwardly of said horizontal axis when said carriage is at said rearward limit of movement relative to said track members, and first spring means coupled between said base and said track means for resiliently biasing said track members to said first limit when said carriage is at said rearward limit.

3. The invention defined in claim 1 further comprising return spring means coupled between said base and said carriage for applying a biasing force urging said carriage toward said rearward end limit when said carriage is at a distance greater than a selected distance away from said rearward end limit.

4. The invention defined in claim 3 wherein said return spring means comprises a tension spring which is slack when said carriage is at a distance less than said selected distance from said rearward end limit.

5. The invention defined in claim 4 further comprising gravitationally biased detent means for releasably maintaining said carriage at said forward end limit against the biasing action of said return spring means, the biasing action of said return spring means when said carriage is at said forward end limit of movement being insufficient to release said detent means when said chair is occupied and being operable to release said detent means when the weight of an occupant is removed from said chair.

6. The invention defined in claim 5 further comprising a plurality of rollers on said carriage supporting said carriage on said track members, said detent means comprising a depression in said track means receiving at least one of said rollers when said carriage is at said forward end limit.

7. The invention defined in claim 1 comprising first spring means coupled between said base and said track members operable to resiliently retain said track members in a rearwardly and downwardly inclined position when said chair is occupied and said chair is in said upright position to gravitationally maintain said carriage at said rearward limit of movement upon said track members.

8. The invention defined in claim 7 wherein an occupant initiated forward movement of said chair frame when said carriage is at said rearward limit is operable to pivot said track members against the biasing action of said first spring means into a forwardly and downwardly inclined position to gravitationally bias said carriage forwardly to said forward end limit.

9. The invention defined in claim 8 further comprising means for releasing said restraining means upon movement of said carriage away from said rearward limit.

* * * * *